US007857142B2

(12) United States Patent
Waites, Jr.

(10) Patent No.: US 7,857,142 B2
(45) Date of Patent: Dec. 28, 2010

(54) MECHANISM FOR SECURING SCREEN MODULES

(76) Inventor: Robert F. Waites, Jr., 220 S. Trace La., Birmingham, AL (US) 35244

( * ) Notice: Subject to any disclaimer, the term of this patent is extended or adjusted under 35 U.S.C. 154(b) by 207 days.

(21) Appl. No.: 12/169,571

(22) Filed: Jul. 8, 2008

(65) Prior Publication Data

US 2010/0006481 A1 Jan. 14, 2010

(51) Int. Cl.
*B07B 1/46* (2006.01)

(52) U.S. Cl. ..... 209/405; 209/408

(58) Field of Classification Search ..... 209/399, 209/403, 405, 408, 412, 319
See application file for complete search history.

(56) References Cited

U.S. PATENT DOCUMENTS

| | | | | | |
|---|---|---|---|---|---|
| 2,956,653 | A * | 10/1960 | Liskey, Jr. | ..... | 52/396.06 |
| 3,759,005 | A * | 9/1973 | Smith | ..... | 52/396.04 |
| 3,980,555 | A | 9/1976 | Freissle | | |
| 4,219,412 | A | 8/1980 | Hassall | | |
| 4,383,919 | A | 5/1983 | Schmidt | | |
| 4,405,272 | A | 9/1983 | Wollar | | |
| 4,661,245 | A | 4/1987 | Rutherford | | |
| 4,716,694 | A * | 1/1988 | Freissle | ..... | 52/127.6 |
| 4,757,664 | A * | 7/1988 | Freissle | ..... | 52/509 |
| 4,909,929 | A * | 3/1990 | Tabor | ..... | 209/400 |
| 5,049,262 | A | 9/1991 | Galton | | |
| 5,213,217 | A | 5/1993 | Galton | | |
| 5,286,152 | A * | 2/1994 | Anderson | ..... | 411/45 |
| 5,372,261 | A | 12/1994 | Galton | | |
| 5,462,175 | A | 10/1995 | Bokor | | |
| 5,464,101 | A | 11/1995 | Freissle | | |
| 5,547,322 | A | 8/1996 | Lilja | | |
| 5,664,685 | A | 9/1997 | Freissle | | |
| 5,755,334 | A | 5/1998 | Wojeik | | |
| 5,967,336 | A | 10/1999 | Baltzer | | |
| 6,253,926 | B1 * | 7/2001 | Woodgate | ..... | 209/399 |
| 6,269,954 | B1 | 8/2001 | Baltzer | | |
| 6,324,731 | B1 * | 12/2001 | Pliml, Jr. | ..... | 24/453 |
| 6,439,392 | B1 | 8/2002 | Baltzer | | |
| 6,672,460 | B2 | 1/2004 | Baltzer | | |
| 7,207,758 | B2 * | 4/2007 | Leon et al. | ..... | 411/45 |
| 7,467,715 | B2 * | 12/2008 | Johnson et al. | ..... | 209/405 |
| 2006/0108264 | A1 | 5/2006 | Moore | | |

* cited by examiner

*Primary Examiner*—Joseph C Rodriguez
(74) *Attorney, Agent, or Firm*—Bradley Arant Boult Cummings, LLP

(57) ABSTRACT

A mechanism for securing screen modules to support frames, said mechanism comprising a plurality of legs for insertion into said support frame, said legs comprising a raised portion that presses against a compatible raised portion of at least one other leg inserted adjacently within the support frame, causing separation of said legs into a restraining relationship with said support frame.

14 Claims, 3 Drawing Sheets

MECHANISM FOR SECURING SCREEN MODULES

BACKGROUND OF THE INVENTION

1. Field of the Invention

The invention relates to mechanisms for securing one object to another. More particularly, this invention relates to mechanisms that secure screen panels to a support structure used to vibrate and separate materials such as aggregates that are placed on the screen modules.

2. Description of Related Art

In the mining and aggregates industries, aggregates are excavated from the ground in large quantities that contain both desired material and undesired material mixed together. The aggregates are separated into desired product lines and any undesired materials are removed. One common method for achieving the separation utilizes a large porous surface, or screen, on which the combined excavated material is placed and sifted. The screens are usually secured to a frame-like structure upon which vibration-type forces are mechanically exerted such that the materials on the screens are shaken, causing certain of the material to filter through the pores of the screen. The repetitive and sometimes excessive forces exerted by the support structure require that the screens be securely affixed so that they do not come loose from the structure.

The screens are usually made of durable material to withstand the repetitive impacts and abrasive forces caused by the bouncing and shaking of the aggregates, which are usually comprised of hardened materials of various shapes and sizes. Even though made of durable material, the screens experience wear and sometimes failure that require replacement. Because the wear or failure is often in an isolated location, screens are frequently comprised of individual panels, or modules, that permit a failed or worn module to be replaced. Relatedly, it is a common practice in the industry to rotate the screen modules to minimize the isolated wear that would otherwise result to an individual screen module. Such rotation of screen modules usually increases the life-span of each module. Without the ability to exchange individual modules, an entire screen surface would have to be replaced even though only a small or isolated portion of the surface had been damaged.

Likewise, it is often necessary to exchange an entire screen grid in order to alter the size aggregate the owner seeks to collect. For all these reasons, it is desirable that the screen modules be securely attached to the support structure while at the same time permit removal and reattachment with relative ease and without causing damage to the screen module locking mechanism.

In such multi-paneled systems, each screen module is usually secured to a support frame and is mated with other compatibly shaped and sized screen modules to form a continuous surface, or grid. Various methods for securing the modules to the support frame have been disclosed and are known in the prior art. Likewise, various methods for mating each module to other compatible modules have been disclosed and are known in the prior art.

Such previously disclosed methods often employ protrusions that extend from the underside of the screen module that fasten by various means to the support frame, often through apertures within the frame. In one prior art embodiment, the protrusions have an annular ridge, the diameter of which slightly exceeds the diameter of the aperture of the support frame that will receive the protrusion. As the protrusion of the screen module is forced through the aperture in the support frame, the ridge interlocks with the underside of the support frame. To enable the ridged protrusion to fit through the slightly smaller aperture and still achieve a locking relationship with the support frame, the protrusion is commonly made of "resiliently deformable material." Examples of such locking protrusions in the prior art are disclosed in Freissle, U.S. Pat. Nos. 4,716,694 and 5,664,685. Various other locking systems have been disclosed in Hassall, U.S. Pat. No. 4,219,412, Schmidt, U.S. Pat. No. 4,383,919, and elsewhere.

Those skilled in the art will appreciate that the use of deformable material such as polyurethane or rubber also allows the unlocking and removal of the screen module from the support frame, but this often occurs with substantial difficulty and can result in damage to the screen module. As is disclosed in Freissle, to remove the screen module, it is usually necessary to apply significant external force in such a manner as to cause the temporary deformation of the protrusion in order to permit its removal from the aperture of the support frame. It will be appreciated that if the person who is responsible for removing the screen module does not exercise appropriate care, permanent damage to the screen module can result rendering the screen module useless.

Another limitation of existing systems occurs because the use of deformable material can lead to compromised locking relationships between the screen module and the support frame. By its very nature, deformable material permits changed shapes—however slight—especially as outside forces act on the material. If such forces are either acute or occur repetitively over time—such as the severe vibration forces exerted by the shaking support frame—deformation of the material can result and can deprive the protrusion of its ability to restrain effectively the screen module against the support frame.

To guard against this sudden or gradual deformation problem, those skilled in the art have often fashioned the locking protrusions using increasingly hardened materials. Of course, increasing the rigidity of the materials necessarily increases the difficulties for attaching and unlocking the screen modules, thereby increasing the likelihood of damage to the system, as well as inefficiencies, during the replacement process.

Another technique commonly used by those skilled in the art in their efforts to address these problems involves the employment of removable pins inserted within protrusions creating outward pressure causing the protrusions to engage the support frame. One such example of this technique is disclosed in Galton, U.S. Pat. No. 5,049,262. Although the pins can be removed thus permitting the screens to be disengaged, such pins can be difficult to handle and are susceptible to being dropped or lost. The pins themselves are susceptible to coming loose by virtue of the vibrational forces of the system.

As a result, there is a need for a locking system that provides increased restraint capabilities between the screen module and the support frame, while at the same time permitting relatively simple and efficient removal and replacement of the screen modules without causing damage to the screen module or the support frame.

OBJECTS OF THE INVENTION

It is an object of the invention to enhance the state of the art in achieving the locking capacity of screen modules to support frames used to separate materials in the aggregate and other industries. It is a further exemplary and alternative object to provide increased locking capacity for screen modules while at the same time permitting relative simplicity in the removal of the same screen modules. In the course of this disclosure, the inventor may refer to certain advantages or capabilities, but it should be understood that such advantages and capabilities, and the objects stated in this paragraph, are alternative and exemplary only, and no one or any should be read as required for the practice of the invention, or as an exhaustive listing of potential advantages or capabilities that may apply, or objects that may be achieved.

BRIEF SUMMARY OF THE INVENTION

Applicant incorporates in certain embodiments described herein a mechanism for securing screen modules to a support frame, comprising a plurality of legs extending from the peripheral underside of each screen module. At least two legs of adjacent screen modules are inserted together through said support frame. Each leg has a first raised portion that will press against a compatibly located raised portion of said second leg leading to separation of said legs restraining them against said support frame. To enhance the restraint, each leg may further comprise a second raised portion generally opposite to and above said first raised portion to enable engagement with said support frame.

DETAILED DESCRIPTION

The following detailed description refers to exemplary embodiments and contains details that may relate to preferences of the inventor, but the invention is not limited to the particular embodiments discussed.

Figure 1:
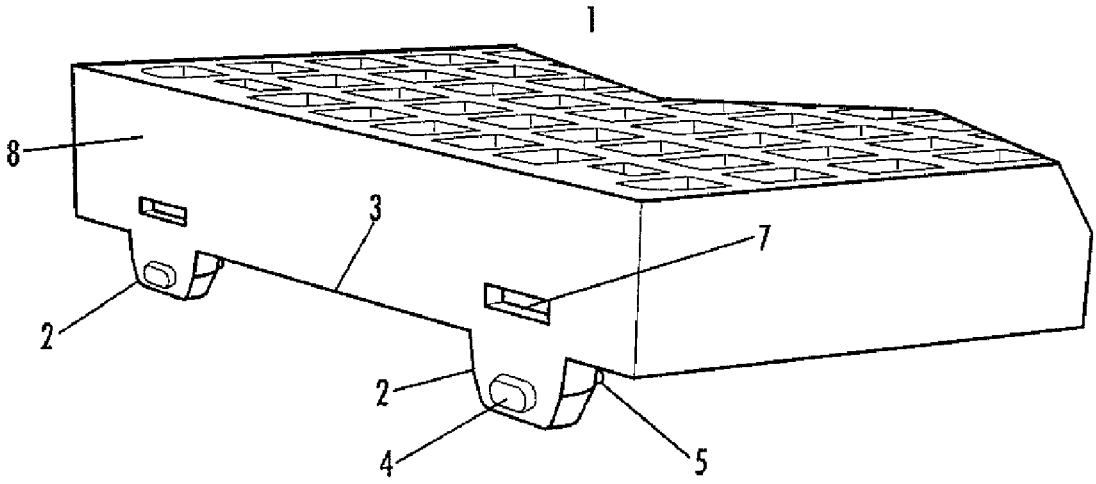
FIG. 1 shows a partial perspective view of the invention.
Figure 3:
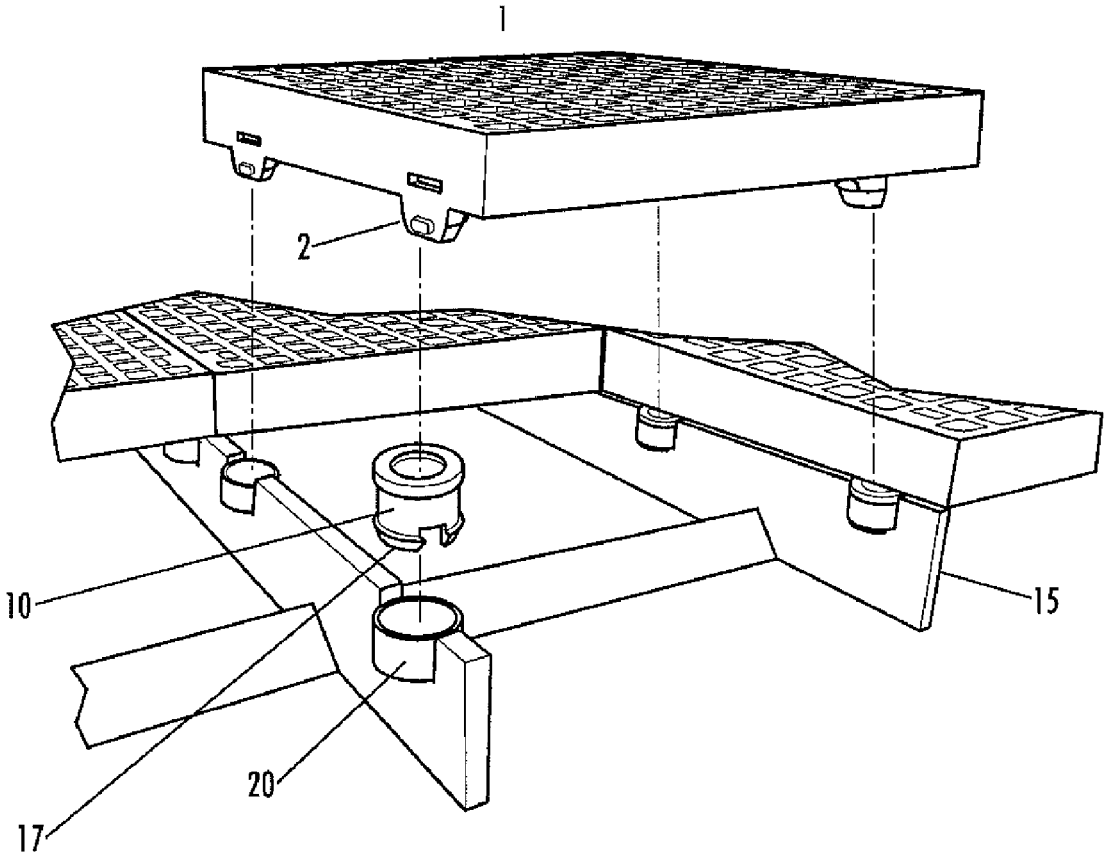
FIG. 3 shows an exploded view of the invention prior to insertion into the support frame.
Figure 4:
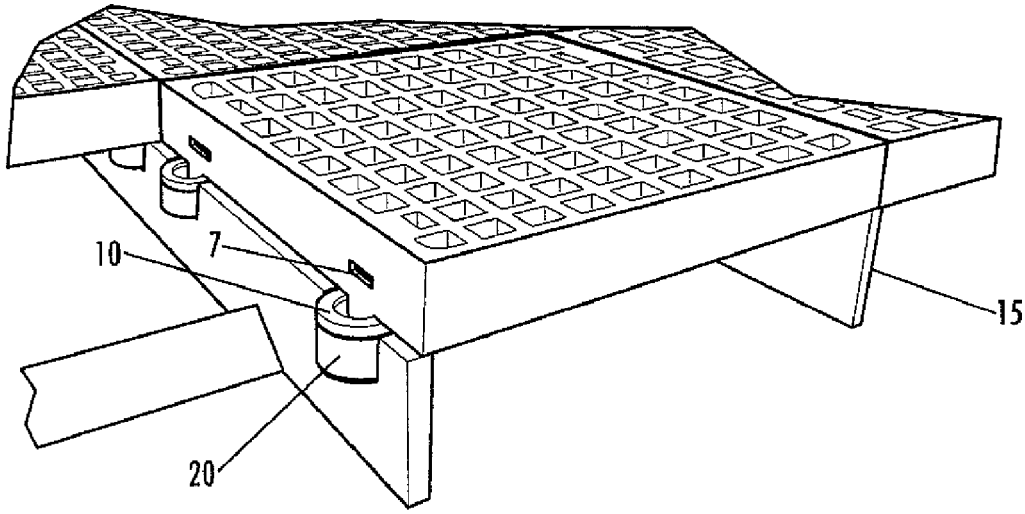
FIG. 4 shows a perspective view of the screen after insertion into the support frame.

FIG. 1 discloses an embodiment of the invention as it is used in securing a screen module 1 to an underlying support frame 15 shown in FIG. 3. Said invention comprises a plurality of legs 2 extending from the undersurface of the screen module 1 at the periphery 3 of each screen module. In a preferred embodiment, the legs are an integral part of the screen module, formed through means such as open cast molding. In addition, the legs are made from durable but elastomeric material such as polyurethane or rubber. It will be appreciated that the length of the legs can vary but should be sufficient to permit the legs to engage in a restrained relationship with the support frame, as will be more readily understood from farther discussion below.

Figure 2:
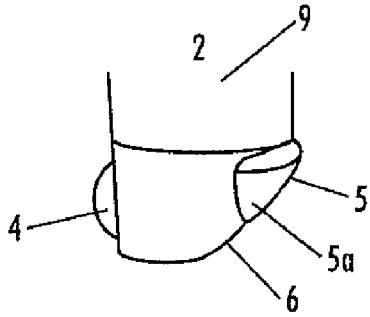
FIG. 2 shows a partial side view of the invention.

Referring to FIG. 2, each leg 2 comprises a neck 9 and a first raised portion 4. In a preferred embodiment, said raised portion is wedge-like, being tapered from base to apex, and is located proximate to the extremity of the leg—that is, the point on the leg opposite the undersurface of the screen module. As will be more readily understood after further discussion below, said first raised portion of said leg is intended to press against a like raised portion of a leg of an adjacent screen module inserted within said support frame. The lateral force exerted by the pressing of the raised portions causes said legs to separate thereby enhancing the locking engagement of the legs to the support frame. The exact size and shape of the wedges can vary and need be sized to cause sufficient separation of the legs. In a preferred embodiment, as reflected in FIG. 1, the wedges 4 have an oval-like cross-section.

Figure 5:
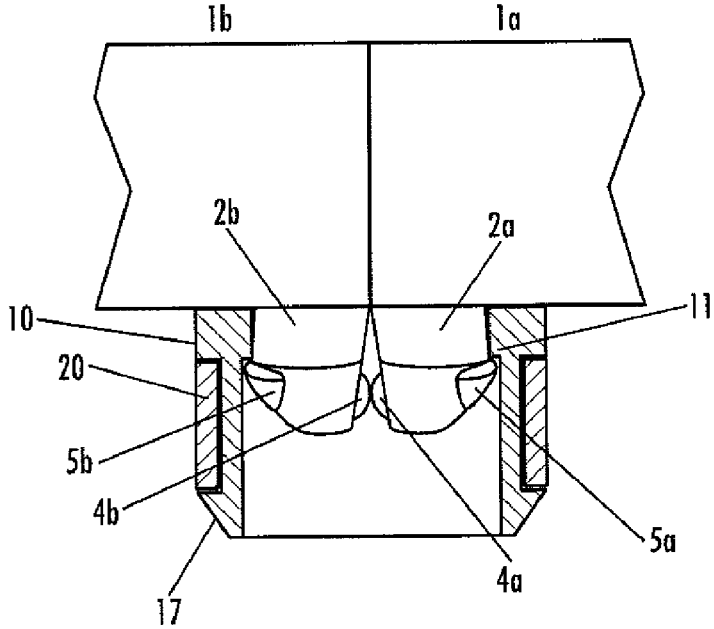
FIG. 5 shows a partial side view of the invention.

Referring to FIG. 2, in an alternative embodiment, to enhance restraint, each leg further comprises a second raised portion 5, or ledge, located generally opposite said wedge and at a point sufficiently below the underside of said screen module to achieve restraining engagement with the support frame 15 shown in FIG. 3. It will be appreciated that the precise location of said second raised portion will depend on the feature of the support frame that will restrain the legs. In one embodiment, said feature is an aperture that permits insertion of said legs through said support frame. In a preferred embodiment, said feature comprises a cylindrically shaped receptacle 10 secured to the support frame 15 and having an annular inner lip 11, as shown in FIGS. 3 and 5. Referring to FIG. 5, the ledge 5 of the leg abuts against the lip 11 of the receptacle 10 thereby preventing the leg from escaping the receptacle, after the leg has been fully inserted into the receptacle. In a preferred embodiment shown in FIGS. 2 and 6, the ledge is crescent-shaped, having tapered extremities 5*a*, such that it spans less than half the circumferential exterior of the leg. In an alternative embodiment, the intersection of the leg and ledge at points closest to the underside of said screen module comprise a curve. In said alternative embodiment, as best show in FIG. 2, said curved intersection comprises an arc whose endpoints are further away from said underside of said screen module than the apex of said arc.

Figure 6:
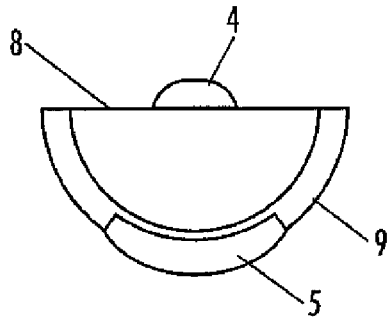
FIG. 6 shows a partial bottom view of the invention.

The general shape of the cross-section of the legs may vary. In a preferred embodiment, as shown in FIG. 6, the cross-section of each leg is semi-circular. In this preferred embodiment, the base of the wedge 4 is located generally on the flat side 8 of the leg, within or parallel to the same plane as the peripheral side 3 of the screen module, while the ledge 5 is located opposite the wedge, generally on the curved exterior 9 of the leg. The vertical separation, if any, between the wedge and the ledge need not be defined with precision; however, in a preferred embodiment, as shown in FIG. 2, the wedge is located opposite and just below the ledge relative to the screen surface. In still another preferred embodiment, said legs have a tapered surface 6 on the curved half, as shown in FIG. 2. It will be appreciated that this feature enhances the insertion of the legs of the screen modules into the support frame.

The size and shape of the cross-section of the receptacle 10 of the support frame will be compatible with the shape of the cross-section of each leg to be received therein. In a preferred embodiment shown in FIGS. 3 and 5, in which each receptacle 10 will receive a pair of semi-circular legs (one each from two adjacent screen modules 1*a* and 1*b*), the receptacle will have a cylindrical cross-section with a diameter measured at the opening defined by the annular inner lip 11 that is slightly less than that of the combined diameter of the two legs, measured from the antipodal points of the ledges 5 when two legs are inserted within the receptacle. In still another preferred embodiment, said neck 9 of said leg will have a circumference that is also slightly greater than the opening of said receptacle 10.

It will be appreciated that the shaking and vibrational forces applied to the support frame can cause wear and, over time, lead to insufficient restraint of the screen module legs. Consequently, there is a need to be able to replace the receptacles without having to replace the entire support frame. Therefore, in a preferred embodiment of the invention shown in FIG. 3, each receptacle 10 is a removable component that can be secured to the support frame 15 using alternative means. In one preferred embodiment shown in FIG. 3, the receptacle 10 has semi-deformable exterior annular flanges 17 that restrain the receptacle within a rigid aperture 20 that is integrally formed within the support frame 15.

In a preferred embodiment the annular lip 11 of the receptacle is made of elastomeric material, often from the same material as that comprising the legs of the screen modules. It will be appreciated that the material should be rigid enough to resist wear and to provide sufficient restraining engagement of the legs. At the same time, the materials used should be sufficiently deformable to permit release of the screen modules as will be described more fully below.

In another alternative embodiment, the invention further comprises a feature to facilitate release of the legs from the receptacle thereby facilitating the removal of the screen module from the support frame. This is accomplished by utilizing an appropriately sized notch 7 located on the peripheral side 8 of the screen module at about the juncture of the leg and the screen. In a preferred embodiment, the opening is a generally horizontal-shaped slot 7 approximately sized to receive the tip of a flat head screwdriver or like implement. It is anticipated that the notch can be located in various places of the screen module.

Looking at FIG. 3, in application, a screen module 1 having a plurality of legs 2 is lowered onto the support frame 15 with the legs of the screen module telescopically guided towards the openings 10 of the support frame. As each screen module is press fitted onto the support frame, the leg 2 enters the opening of the receptacle 10. Looking at FIG. 5, increased restraint is achieved once an adjacent screen module 1*b* is placed onto the support frame such that the legs 2*a* and 2*b* of said adjacent screen modules are compressed within said receptacle 10 of said frame. In a preferred embodiment having cylindrical receptacles designed to receive two semicircular legs of adjacent screen modules, as the second leg 2*b* is telescopically received into the receptacle, the two wedges of the legs, 4*a* and 4*b* respectively, engage one another naturally causing the legs to separate, thereby restraining said legs to said frame. As disclosed above, enhanced restraint occurs as a result of ledges 5*a* and 5*b* abutting against annular lip 11 of receptacle 10.

The detailed description set forth herein is illustrative only, and shall not be construed as limiting the scope to the embodiments described. Persons of ordinary skill in the art will understand additional embodiments are possible within the scope of this invention.

I claim:

1. A mechanism for securing screen modules to a support frame comprising a plurality of legs extending from said screen module for insertion into said support frame, said legs comprising a first raised portion that presses against a compatible raised portion of at least one other leg inserted adjacently within the support frame, causing separation of said legs into a restraining relationship with said support frame, said leg further comprising a second, crescent-shaped raised portion positioned about opposite and above said first raised portion.

2. The mechanism of claim 1 wherein said leg has a semicircular cross section, having said first raised portion on the flat side of said leg and further having said second raised portion on said curved side of said leg.

3. The mechanism of claim 2 further comprising a receptacle within said support frame for receiving at least two of said legs, said receptacle having an annular inner lip having a diameter that is slightly less than the combined diameter of the two legs measured from the antipodal points of the second raised portions when said two legs are inserted therein.

4. The mechanism of claim 1 further comprising a notch within the peripheral surface of said screen module for receiving an instrument for removing said module.

5. The mechanism of claim 1 wherein said second raised portion intersects said leg in curved fashion.

6. The mechanism of claim 5 wherein said curved intersection comprises an arc having endpoints further away from said screen module than the apex of said arc.

7. A mechanism for securing screen modules to a support frame comprising a leg having a flat side and a curved side, said leg further comprising a first raised portion located on said flat side, said leg further comprising a second raised portion located on said curved side at about a position opposite and above said first raised portion, said second raised portion being crescent-shaped.

8. The mechanism of claim 7 wherein said second raised portion spans less than all of said curved side of said leg.

9. The mechanism of claim 7 wherein said first raised portion is tapered from its base.

10. The mechanism of claim 7 further comprising an opening for receiving a removal tool, said opening being located about above where said leg extends from said screen module.

11. The mechanism of claim 7 further comprising a receptacle secured to said support frame, said receptacle having an inner annular lip that restrains said legs when said legs are inserted therein.

12. The mechanism of claim 11 wherein said receptacle further comprises deformable annular flanges for restraining said receptacle within a rigid aperture integrally formed within said support frame.

13. The mechanism of claim 1 wherein said legs are tapered.

14. The mechanism of claim 7 wherein said leg is tapered.

* * * * *